United States Patent [19]

Putt

[11] Patent Number: 4,832,578

[45] Date of Patent: May 23, 1989

[54] MULTI-STAGE COMPRESSOR

[75] Inventor: James C. Putt, Doylestown, Ohio

[73] Assignee: The B.F. Goodrich Company, Akron, Ohio

[21] Appl. No.: 132,662

[22] Filed: Dec. 10, 1987

Related U.S. Application Data

[63] Continuation of Ser. No. 930,628, Nov. 14, 1986, abandoned.

[51] Int. Cl.[4] ..... F04B 25/02; F04B 35/04

[52] U.S. Cl. ..... 417/266; 417/418

[58] Field of Search ..... 417/416, 417, 244, 259, 417/256, 265, 266, 267, 268, 260, 418, 470, 471; 92/135

[56] References Cited

U.S. PATENT DOCUMENTS

| | | | |
|---|---|---|---|
| 456,165 | 7/1891 | Sergeant | 417/260 |
| 1,633,998 | 6/1927 | Patart | 417/266 |
| 1,978,866 | 10/1934 | König | 417/417 |
| 2,462,001 | 2/1949 | Rapisarda | 417/417 X |
| 2,465,688 | 3/1949 | Jenkins | 417/259 |
| 2,738,659 | 3/1956 | Heed | 417/268 X |
| 3,070,024 | 12/1962 | Romberg | 417/417 |
| 3,075,471 | 1/1963 | Miller | 417/416 X |
| 3,601,505 | 8/1971 | Bratsch | 417/266 |
| 4,026,468 | 5/1977 | Tinder et al. | 417/523 |
| 4,334,833 | 6/1982 | Gozzi | 417/268 |
| 4,345,880 | 8/1982 | Zanarini | 417/264 |
| 4,369,633 | 1/1983 | Snyder | 417/254 |

FOREIGN PATENT DOCUMENTS

| | | | |
|---|---|---|---|
| 299790 | 8/1932 | Italy | 417/266 |
| 572513 | 10/1945 | United Kingdom | 417/416 |
| 717633 | 10/1954 | United Kingdom | 417/417 |

OTHER PUBLICATIONS

*Linear Motor Drive for Air Compressor,* Electrical Times, vol. 157, No. 12, 4/9/70, p. 31.

*Primary Examiner*—Carlton R. Croyle
*Assistant Examiner*—Leonard P. Walnoha
*Attorney, Agent, or Firm*—Joesph Januszkiewicz

[57] ABSTRACT

A three-stage compressor wherein the housing proper has a central bore with two adjacent bores that are co-axial therewith. A first piston is cooperative with the central bore to define a first stage compression chamber. A second piston smaller than the first piston but integral therewith is received by one of the adjacent bores to define a second stage compression chamber that receives its pressurized air from the first chamber. A third piston smaller than the second piston is received by the remaining one of the adjacent bores to define a third stage compression chamber that receives its pressurized air from the second chamber for further compression.

7 Claims, 2 Drawing Sheets

MULTI-STAGE COMPRESSOR

This is a continuation, of application Ser. No. 930,628, filed Nov. 14, 1986. Now abandoned

BACKGROUND OF THE INVENTION

The present invention relates to compressors and more particularly to a new and improved multi-stage liner compressor for use in supplying high pressure pneumatic air.

The compressor of the present invention is directed to a small reciprocating multi-stage compressor for developing a low flow rate of high pressure gas or air such as is needed in the servicing of pneumatic deicers on aircraft. such multi-stage compressor is a small compact unit that utilizes a mechanical and electrical means for reciprocating the piston means to produce pressure multiplication in each of three stages. Such compressor design utilizes linear motion and eliminates the need for rotary to linear conversion devices and the associated wear therewith.

SUMMARY OF THE INVENTION

A multi-stage compressor having a housing with a central bore and two adjacent spaced bores. A piston mounted in the central bore has two oppositely disposed cylindrical extensions that act as pistons and are received by the spaced bores, respectively. This pistons are reciprocated by intermittent energization and de-energization of an electromagnetic coil and spring biasing means such that three chambers defined by the bores and the pistons are all interconnected by suitable check valve means to provide for a three-stage compressor.

DETAILED DESCRIPTION

Figure 1:
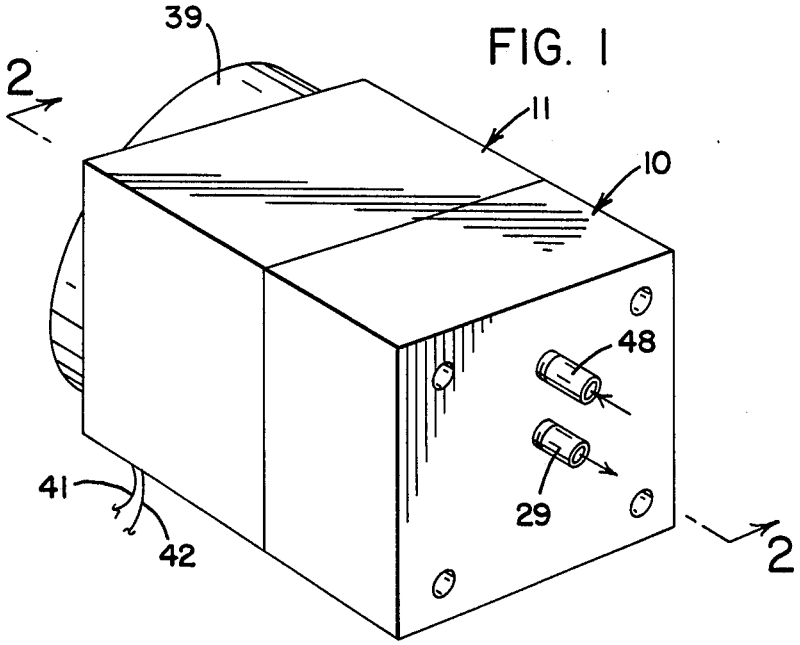
FIG. 1 is a perspective view of the invention.
Figure 2:
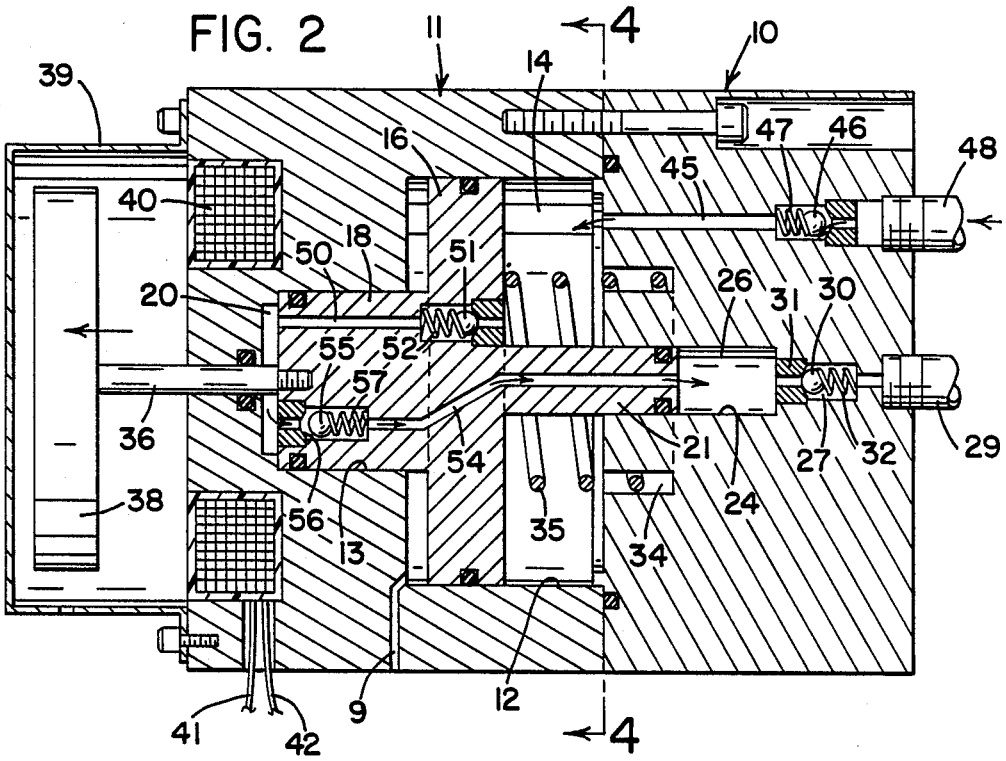
FIG. 2 is a cross-sectional view of a three-stage compressor taken on line 2—2 of FIG. 1 showing compression of air in the second stage.

Referring now to the drawings, wherein like reference numerals designate like or corresponding parts throughout the several views, there is shown in FIGS. 1 and 2 a two-part housing 10 and 11. Housing 11 has a stepped central bore with an enlarged central bore portion 12 and a reduced bore portion 13 coaxial therewith. Housing 10 is suitably secured to housing 11 to close off enlarged bore portion 12 to define a closed chamber 14, a first compression chamber.

A piston 16, mounted in chamber 14 for reciprocation therein, has a reduced cylindrical portion 18 which is closely received by the bore portion 13. Housing 11 has a cylindrical recess adjacent to one end of the reduced cylindrical portion 13 that cooperative with said central bore to define a chamber 20 and a second stage compression chamber.

That portion of the central bore opposite to the first chamber that surrounds the reduced cylindrical portion 18 adjacent to the first piston 16 defines a chamber that is vented to atmosphere via a port 9.

Piston 16 has a cylindrical portion 21 extending outwardly therefrom in a direction opposite to the reduced cylindrical portion 18 and is integral therewith. Such reduced portion 21 defines a third piston which is slidingly received by a cylindrical bore 24 in housing 10 that is co-axial with enlarged bore 13 and chamber 14. Such piston 21 cooperates with the bore 24 to define a chamber 26, a third stage compression chamber. Chamber 26 is connected via stepped passageways 27 to a conduit 29 which in turn can be connected to an accumulator for storing compressed gases or connected directly to its place of use. The compressed air from chamber 26 is controlled by a check vlave 30 held on its annular seat 31 by a spring 32. Housing 10 has an annular recess 34 which forms a seat for a compression spring 35 that engages piston 16 and urges piston 16 leftwardly as viewed in FIG. 2 to provide a compression stroke of piston 18 on air to chamber 20. Piston 18 is connected via piston rod 36 to a cylindrical armature 38 made of ferrous material. Such armature 38 is enclosed by a cylindrical housing 39. Mounted in one end of housing 11 is an annular coil 40 which via conductors 41 and 42 is supplied with either a pulsed DC or a clipped alternating current at the desired frequency so as to produce an on-off-on-off sequencing of a magnetic field which will sequentially draw the ferrous armature 38 to it. This action is coupled with the bearing action of spring 35 which pushes the armature 38 away from the coil 40. This cooperative action of the on-off sequencing of the coil 40 and the biasing acton of spring 35 produces a reciprocating action to the pistons and the multi-stage compressing of the gases as to be described.

The first compression chamber 14 is connected via passageway 45 to a one-way check valve 46 held on its annular seat member by a spring 47. Upon movement of the piston 16 in a leftward direction as depicted by FIG. 2, check valve 46 will move leftward against spring 47 due to the suction action of moving piston 16 thereby unseating such ball valve 46 allowing air to be drawn into chamber 14 via passageway 45 which is shown connected to conduit 48 which in turn is connected to atmosphere.

Chambers 14 and 20 are interconnected by a passageway 50 controlled by a check valve 51 held to its seat member by a spring 52. Chambers 20 and 26 are interconnected via passageway 54 extending through pistons 18-16-21 and controlled by a ball valve 55 held to its seat 56 by a spring 57. Although check valves have been described, any suitable one-way flow valve may be used.

Figure 3:
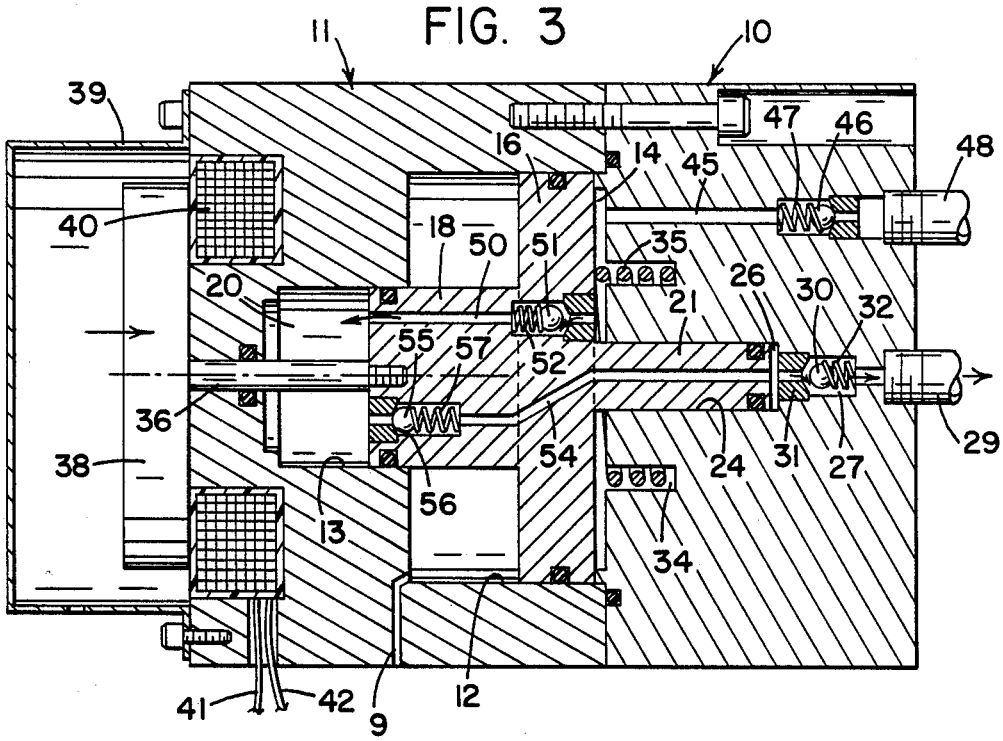
FIG. 3 is a cross-sectional view of the three-stage compressor similar to the view shown in FIG. 2 with the piston means in the reverse mode showing compression in the first and third stages.
Figure 4:
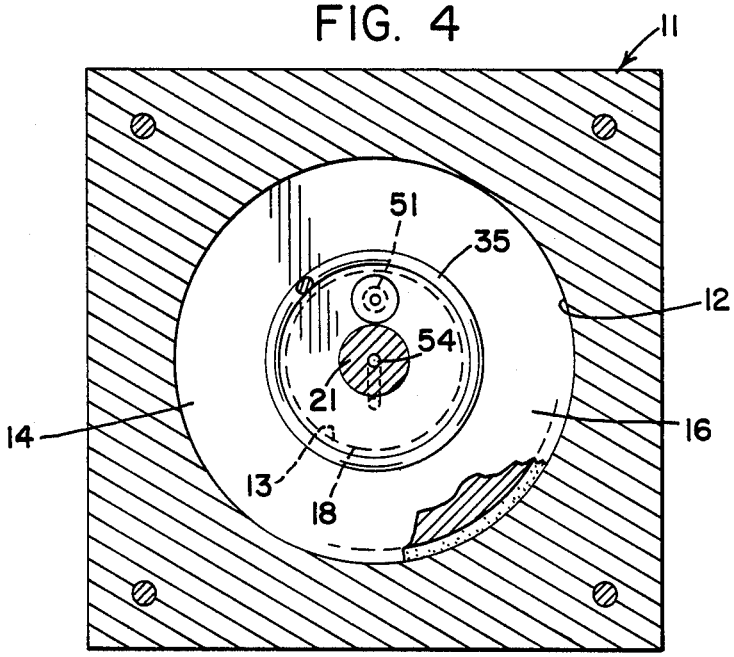
FIG. 4 is a cross-sectional view of the compressor taken on line 4—4 of FIG. 2.

In the operation of the compressor as described above, spring 35 will move the piston 16 in a leftward direction as viewed in FIG. 2, which action draws in air past check vlave 46 into the first stage compression chamber 14. Simultaneously with this action air is being compressed in the second stage compression chamber 20 and forced past one-way check valve 55 into the third stage compression chamber 26. With this action the armature 38 is moved leftward (as viewed in FIG. 2) away from the coil 40. Upon energization of coil 40, a magnetic field is set up to move the armature 38 rightwardly (as viewed in FIG. 2) toward the coil 40 to the position shown in FIG. 3 thereby compressing spring 35. During this action, piston 16 compresses the air within chamber 14 and directs such pressurized air past check valve 51 and via passageway 50 to chamber 20.

Simultaneously with this action, the pressurized air in chamber 26 is further compressed and thence directed past check valve 30 and via passageway 27 to conduit 29 for storage in the accumulator for subsequent use. The respective springs 47, 32, 57 and 52 are proportioned to assure the functioning of the device as described above. Coil 40 is then de-energized and spring 35 will then move the piston 16 as described above followed by the energization of coil 40. This on-off sequencing of the coil with the cooperative action of spring 35 effects the three stage compression cycles to effectively provide a low flow rate of high pressure gas or air for serving pneumatic deicers.

The invention has been described with respect to a three-stage compressor however the invention is equallay applicable to include additional stages by the use of progressively smaller diameter bores and pistons arranged in alternating opposing configurations in a manner similar to the first, second and third stages as described above.

Various modifications are contemplated and may obviously be resorted to by those skilled in the art without departing from the described invention, as hereinafter defined by the appended claims, as only a preferred embodiment thereof has been disclosed.

I claim:

1. A multi-stage compressor having a housing with a central bore, said housing having a pair of spaced bores smaller than said central bore and communicating therewith, one of spaced bores being larger in diameter than the other of said spaced bores, a first piston slidably received by said central bore to define a first chamber, a second piston integral with said first piston slidably received by said one bore to define a second chamber, said second piston cooperative with said first piston and said central bore to define an annular chamber, a third piston integral with said first piston slidably received by said other one of said spaced bores to define a third chamber, a first passageway extending through all of said pistons interconnecting said second chamber with said third chamber, a second passageway extending through said first piston and said second piston for interconnecting said first chamber with said second chamber, first valve means interconnecting said first chamber to atmosphere while a second valve means located in said first passageway simultaneously interconnects said second chamber with said third chamber on movement of said first piston in a first direction, third valve means located in said second passageway interconnecting said first chamber with said second chamber while a fourth valve means interconnects said third chamber with gas pressure storage means on movement of said first piston in a second direction opposite to said first direction, a rod interconnecting said second piston to an armature for movement therewith, an electromagnetic coil in said housing operative on energization to move said armature and said first piston in said second direction, and spring means in said first chamber operatively contacting said first piston and operative upon de-energization of said coil to move said first piston in said first direction.

2. A multi-stage compressor as set forth in claim 1 wherein said second piston extends into said first chamber and cooperates with said first piston to make said first chamber an annular chamber, and said annular chamber is vented to atmosphere.

3. A multi-stage compressor as set forth in claim 2 wherein all of said valve means are spring loaded ball valves.

4. A multi-stage compressor as set forth in claim 3 wherein said first valve means and said second valve means are unseated as said first piston moves in said first direction while said third and fourth valve means are seated in closed condition.

5. A multi-stage compressor as set forth in claim 4 wherein said third valve means and said fourth valve means are unseated as said first piston moves in said second direction while said first and second valve means are seated in a closed condition.

6. A multi-stage compressor having a housing with a central bore, said housing having a pair of spaced bores smaller than said central bore and communicating therewith, one of spaced bores being larger in diameter than the other of said spaced bores, a first piston slidably received by said central bore, said first piston having a face that is cooperative with said central bore to define a first stage compressionchamber, a second piston integral with said first piston slidably received by said one bore, said second piston having a surface that is cooperative with said one bore to define a second stage compression chamber, a third piston integral with said first piston slidably received by said other one of said spaced bores, said third piston having a head cooperative with said other one of said bores to define a third stage compression chamber, first valve means interconnecting said first chamber to atmosphere, a first passageway extending through all of said pistons to interconnect said second chamber with said third chamber, a spring biased check valve operative in said passageway adjacent said surface of said second piston to interconnect said second chamber with said third chamber on movement of said first piston in a first direction, a second passageway extends through said first piston and said second piston to interconnect said first chamber to said second chamber, a spring loaded check-valve in said second passageway adjacent to said face of said first piston operative to pass pressurized fluid from said first chamber to said second chamber on movement of said first piston in a second direction opposite to said first direction, a spring loaded check valve interconnects said third chamber via a third passageway located in said housing with a gas pressure storage means on movement of said first piston in said second direction, a rod interconnecting said second piston to an armature for movement therewith, an electromagnetic coil in said housing operative on energization to move said armature and said first piston in said second direction, and spring means in said first chamber operatively contacting said first piston and operative upon de-energization of said coil to move said first piston in said first direction said piston slidably received by said other one of said spaced bores extends into said first chamber to make said first chamber an annular chamber, said spring means encompasses said piston in said other one of said spaced bore.

7. A multi-stage compressor as set forth in claim 6 wherein said second piston cooperates with said first chamber and said first piston to define an annular chamber, and said annular chamber is vented to atmosphere.

* * * * *